United States Patent [19]

Hawley

[11] Patent Number: 4,566,297

[45] Date of Patent: Jan. 28, 1986

[54] ELECTRICAL PLUG LOCKING DEVICE

[76] Inventor: Robert C. Hawley, 3079 Calle Pinon, Santa Barbara, Calif. 93105

[21] Appl. No.: 516,701

[22] Filed: Jul. 22, 1983

[51] Int. Cl.[4] ..... E05B 65/00; H01R 4/54

[52] U.S. Cl. ..... 70/57; 339/91 B

[58] Field of Search ..... 70/57, 58; 292/252; 339/91 B

[56] References Cited

U.S. PATENT DOCUMENTS

| | | | |
|---|---|---|---|
| 2,198,504 | 4/1940 | Pool | 339/91 B |
| 2,631,185 | 3/1953 | Earle et al. | 339/91 B |
| 2,654,073 | 9/1953 | Katz | 70/57 X |
| 2,733,416 | 1/1956 | Evalt | 70/57 X |
| 3,229,240 | 1/1966 | Harrison, Sr. et al. | 339/91 B |

*Primary Examiner*—Richard E. Moore

*Attorney, Agent, or Firm*—Daniel J. Meaney, Jr.

[57] ABSTRACT

A locking device for use with an electrical plug having a pair of spaced, parallel tines each of which has an aperture located at a selected end and wherein the apertures are positioned in spaced axial alignment with each other and the locking device includes a housing having an opening which is adapted to receive and pass the ends of the tines, a releasable locking member located within the housing and adjacent to the opening and which includes an elongated member having a circumferentially extending continuous slot formed around the periphery thereof at a selected location and which has a geometrical dimension which is smaller than the geometrical dimension of the outer surface of the elongated member and wherein the elongated member is slideably mounted within the housing for linear movement relative to the ends of the tines between a first position where the slot is remote from the apertures in the tines and a second position where the slot is located between the ends of the tines containing the apertures and substantially in alignment with the apertures and a pair of spherical members each having a diameter which is substantially equal to the distance between the outer surface of the elongated member and the tines and wherein the spherical members are positioned and develop a locking force between the outer surface of the elongated member and the apertures to urge the spherical members into the apertures locking the tines in the opening when the elongated member is in the first position and wherein the spherical members are moved away from the apertures when the elongated member is in the second position enabling the tines to be free of the locking force enabling the tines to be removed from the housing opening is shown.

20 Claims, 14 Drawing Figures

ELECTRICAL PLUG LOCKING DEVICE

BACKGROUND OF THE INVENTION

1. Field of the Invention

This invention relates to a locking device for an electrical plug to control access thereto and more particularily to a security locking device for electrical plugs for electrical equipment to control use thereof by means of a accessing means in combination with a housing having a releasable locking means which receives and passes the tines of the electrical plug within an opening on the housing and which selectively applies and releases a locking force to the tines of the plug to control removal thereof from the housing member.

2. Description of the Prior Art

The use of a locking device for use with an electrical plug is known in the prior art. One such device is disclosed is U.S. Pat. No. 3,543,544 and comprises a housing which is adapted to receive the plug prongs and includes spring-loaded pawls pivotally mounted within the housing for retaining the plug prongs within the housing by frictional engagement and a combination lock for releasing the pawls and the prongs secured thereby.

Another plug locking and protecting device is disclosed in U.S. Pat. No. 2,844,805 and comprises a two-part casting having an aperture open at one end with one or more tine engaging elements projecting transversly from the parts into the aperture for interlocking with the tines and means for registering and locking the two parts of the casting together with the tines of the plug held in the aperture.

A yet another locking device for use with electrical plugs is disclosed in U.S. Pat. No. 2,733,416 which comprises a casing having openings to receive the prongs, a pair of opposed locking members arranged within the casing which are adapted for translational movement from an outer unlocking position to a locking position, wherein the locking members have pins which pass through the apertures in the plugs, a manual means for moving the the locking members into the locking position and a key-releasable detent means for holding the locking member in the locking position.

Other forms of plug locking devices having pins or members which pass through the apertures in the tines of the plugs are disclosed in U. S. Pat. Nos. 3,422,389 and 2,664,734

An electrical plug with a linear transportable plug prong for withdrawing at least one tine into a housing is disclosed in U.S. Pat. No. 2,879,494.

A number of devices are known which contain a lockable housing for enclosing a plug with devices disclosed in U.S. Pat. No. 2,955,272 being typical.

SUMMARY OF THE INVENTION

This invention relates to a new, novel and unique locking device for use with an electrical plug having a pair of spaced, parallel tines wherein each of the tines has an aperture located at a selected end thereof. In the typical electrical plug, the apertures are positioned in spaced axial alignment with each other. The locking device comprises a housing having an opening at one end thereof which is adapted to receive and position the selected ends of the tines at a predetermined location along a predetermined path within the housing. The locking device further includes a releasable locking means located within the housing and opening. The releasable locking means includes an elongated member having first and second ends and a circumferentially extending continuous slot formed around the periphery thereof at a selected location between the first and second ends. The slot has a geometrical dimension which is smaller than the geometrical dimension of the outer surface of the elongated member. The elongated member is slideably mounted within the housing for linear movement relative to the predetermined path between a first position wherein the slot is remote from the portions of the predetermined location adapted to receve the selected ends of the tines containing the apertures and a second position wherein the slot is located along the predetermined path and between the predetermined locations adapted to receive the selected ends of the tines containing the apertures. In the second position the slot is positioned substantially in alignment with the apertures of the selected ends of the tines located at the predetermined locations. The locking means further comprises a pair of spherical members each having a diameter which is substantially equal to the distance between the outer surface of the elongated member and the tines. The said spherical members are adapted to be positioned between the said outer surface of the elongated member and the apertures in the selected ends of the tines for developing a locking force between the outer surface of the elongated member and the selected ends of the tines urging the spherical members into the aperture locking the tines in the opening when the elongated member is in the first position. The spherical members are adapted to be moved away from the apertures in the selected ends of the tines when the same are located in the predetermined locations and into the slot when the elongated member is in the second position enabling the tines to be free of the locking force of the spherical members in the apertures enabling the tines to be removed from said housing opening.

The prior art locking devices for use with an electrical pluq have a number of disadvantages. One primary disadvantage is that the menchanisms for frictionally locking or passing a pin or other member through the apertures in the tines to lock the plug within a housing are complicated mechanical devices. The devices require a large number of parts and require two or more mechanical operatons to secure the plug. Such devices are difficult to manufacture and assemble. Further, the means for locking and unlocking the device is cumbersome and makes use therof difficult for the user.

One advantage of the present invention is that the locking device includes a releasable locking means which is simple in both construction and operation.

Another advantage of the present invention is that the locking device is easy to use in that the user merely actuates the accessing means and inserts the tines of the plug into an opening in the housing and the plug is secured without any further movements on the part of the user.

A yet another advantage of the present invention is that the plug when in a secured position in the opening of the housing and the user desires to remove the plug from the housing, the user actuates an accessing means, such as a combination lock or a key lock, and removes the plug from the housing.

A still yet another advantage of the present invention is that locking device of the present invention can be easily attached to the end of an electrical plug of a piece of electrical equipment to prevent the unauthorized use of the same.

BRIEF DESCRIPTION OF THE DRAWING

The foregoing and other advantages and features of this invention will become apparent from the following description of the preferred embodiment, when considered together with the illustrations and accompanying drawing which includes the following Figures.

DESCRIPTION OF THE PREFERRED EMBODIMENT

Figure 1:
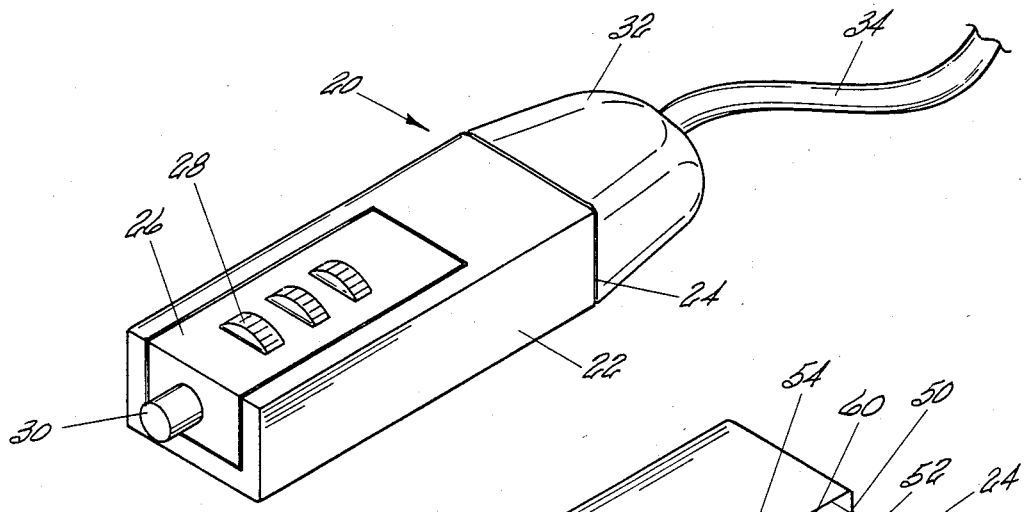
FIG. 1 is a top perspective view of a locking device of the present invention having an electrical plug inserted therein.

FIG. 1 discloses a locking device, generally identified by arrow 20, which is adapted for use with an electrical plug 32. Electrical plug 32 is connected via an electrical cable 34, which may be a two or three conductor cable, to an electical apparatus, such as a copier or a computer, to be secured and protected by the locking device 20. The locking device 20 includes a housing 22 having at least one opening 24 therein which is adapted to to receive the tines of an electrical plug 32. The locking device 20 includes an accessing means 26 which, in the preferred embodiment, is a combination lock having rotatable programming means 28. When the rotatable programming means 28 is programmed to the preprogrammed combination, a slideable member 30 may be operated by a user applying a force on the end thereof and pushing the same towards the opening 24.

In operation, the user sets the combination in the combination lock, pushes slideable member 30 towards the openings 24 and merely inserts the tines of the electrical plug 32 into the openings 24 in the housing 22. When the electrical plug 32 is removed from an electrical outlet and inserted into the locking device 22, the electrical apparatus is disabled and cannot be removed from the locking device 20 without accessing the accessing means 26. If a user decides to utilize the secured electrical apparatus, the user sets the combination on the combination lock 28 and pushes the slideable member 30 towards the opening 24 and removes the electrical plug 32 from the locking device 22 and plugs the same into an electrical outlet.

Figure 2:
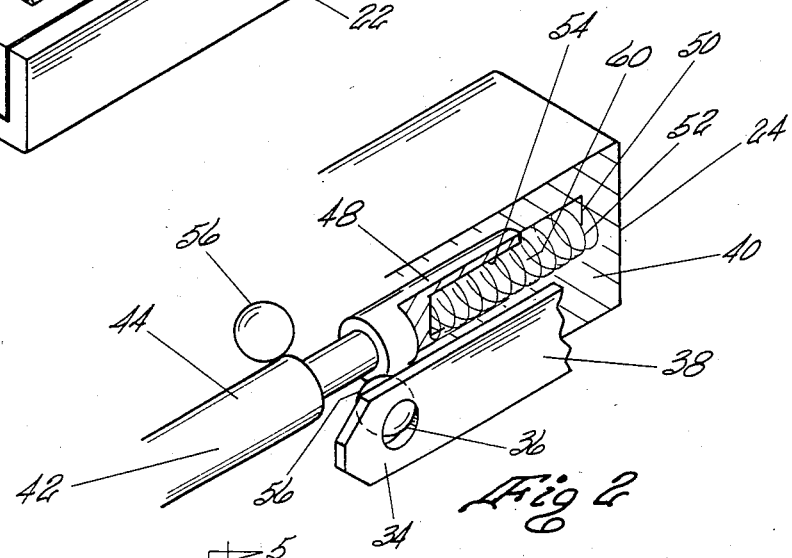
FIG. 2 is a pictorial representation partially in cross-section showing the releasable locking means.

FIG. 2 discloses the details of the interior of the housing 24 and at least one releasable locking means located within the housing 22 adjacent the opening 24. As illustrated in FIG. 2, the housing device 22 includes means 40 defining a central cavity 50 located intermediate a spaced predetermined path adapted to receive the tines 38 of an electrical plug 32. The housing 22 has at least one opening 24 formed therein which is adapted to position the selected end 34 of a tine 38 at predetermined location along a predetermined path within the central area 40 of the housing 22. The selected end 34 of tine 38 includes means defining an aperture 36.

In a typical electrical plug 32, as illustrated in FIG. 1, the plug includes a pair of spaced, parallel tines wherein each of the tines, such as tine 38 in FIG. 2, has an aperture 36 located at a selected end 34 thereof. Each of such apertures are positioned in spaced axial alignment with each other with tine 38 in FIG. 2 being typical.

The releasable locking means located within the central cavity 50 of the housing 22 adjacent the openings 24 includes an elongated member 46 having first end portion 44 and a second end portion 48 and a circumferentially extending continuous slot 46 formed around the periphery thereof at a selected location between the first end portion 44 and the second end portion 54. The slot 46 has a geometrical dimension which is smaller than the geometrical dimension of the outer surface of the elongated member end portions 44 and 48. The elongated member 48 is slideably mounted within the housing 22 for linear movement relative to the predetermined paths between a first position and a second position illustrated in FIGS. 7(*a*), 7(*b*) and 7(*c*).

FIG. 2 also illustrates that the second end portion 48 of the elongated member 48 closest to the housing openings 24 has a hollowed-out area 60 formed therein having an opening which is adapted to communicate with the central cavity 50. The resilient means, which in the preferred embodiment is a spiral spring 52, extends between the central cavity 50 and the hollowed-out central area 60 to apply a force on the elongated member 42 in a direction to urge the same into the first position illustrated in FIG. 7(*c*).

The releasable locking means located within the housing 22 includes a pair of spherical members 56 each having a diameter which is substantially equal to the distance between the outer surface of the said elongated member second end portion 48 and the tines 38 of the plug 32 adapted to be positioned within the openings 24. The spherical members 56 are adapted to be positioned between the outer surface of the elongated member and the apertures 36 in the selected ends 34 of the tines 38 for applying a locking force between the outer surface of the elongated member 42 and the selected ends 34 of the tines urging the spherical members 56 into the apertures 36 locking the tines 38 in the openings when the elongated member 42 is in the first position illustrated in FIG. 7(*c*). The spherical members 56 are being adapted to be moved away from the apertures 36 in the selected ends 34 of tines and into the slot 46.

Figure 3:
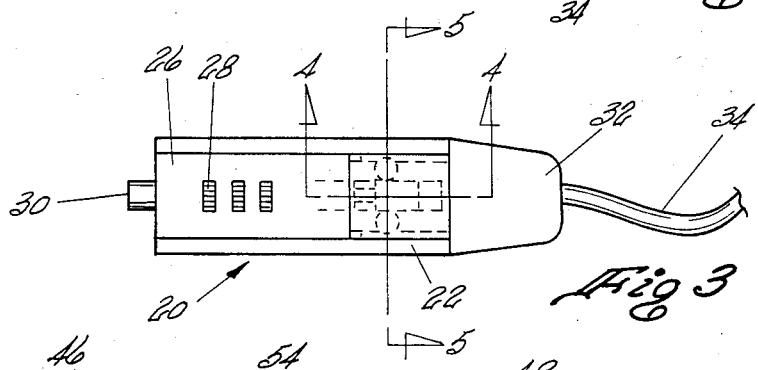
FIG. 3 is a top plan view of the locking device of FIG. 1.

FIG. 3 illustrates the geometrical relationship between the plug 32 and the housing 22 of the locking device 20. The housing 22 includes the releasable locking means in phantom to show the relative position thereof within the housing 22 and the accessing means 26. When the combination lock 28 of FIG. 3 is set to the correct combination, the slideable member 30 mechanically can move in a linear direction and engage the elongated member 42 and apply a restoring force thereon to override the resilient means 52 illustrated in FIG. 2.

Figure 4:
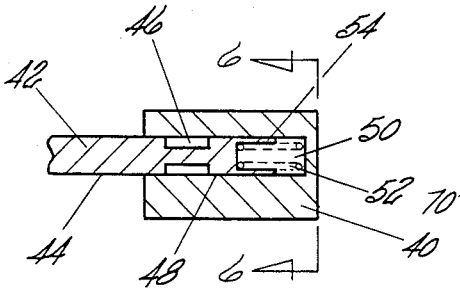
FIG. 4 is a section view taken along section lines 4—4 of FIG. 3.

FIG. 4 illustrates that the elongated member 46 has a greater geometrical dimension at ends 44 and 48 that the geometrical dimension of the slot 46. The spiral spring 52 of the preferred embodiment is located in the central cavity 50.

The releasable locking means located within the housing 22 includes a pair of spherical members 56 each having a diameter which is substantially equal to the distance between the outer surface of the elongated member's 42 second end portion 48 and the tines 38 of the plug 32 adapted to be positioned within the openings 24. The spherical members 56 are adapted to be positioned between the outer surface of the elongated member 42 and the apertures 36 in the selected ends 34 of the tines 38 for applying a locking force between the outer surface of the elongated member 42 and the selected ends 34 of the tines 38. The spherical members 56 are urged into the apertures 36 locking the tines 38 in the openings 24 when the elongated member 42 is in the first position illistrated in FIG. 7(*c*). The spherical members 56 are adapted to be moved away from the apertures 36 in the selected ends 34 of tines 30 and into the slot 46.

FIG. 3 illustrates the geometrical relationship between the plug 32 and the housing 22 of the locking device 20. The housing 22 includes the releasable locking means in phantom to show the relative position thereof within the housing 22 and relative to the accessing means 26. When the combination lock 28 of FIG. 3 is set to the correct combination, the slideable member 30 mechanically can move in a linear direction and engage the elongated member 42 and apply a restoring force thereon to override the resilient means 52 illustrated in FIG. 2.

FIG. 4 illustrates that the elongated member 46 has a greater geometrical dimension at ends 44 and 48 than that of geometrical dimension of the slot 46. The resilient means, which in the preferred embodiment is a spiral spring 52, is located in both the central cavity 50 in housing center 40 and in the hollowed-out central area 60 of the end 48 of the elongated member 42.

Figure 5:
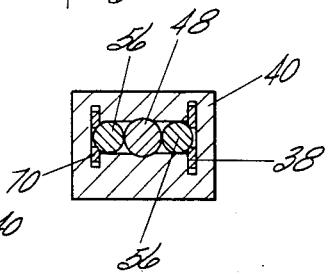
FIG. 5 is a section view taken along section lines 5—5 of FIG. 3.

FIG. 5 illustrates the second end portion 48 cooperating with spherical members 56 to develop the locking force between the end portion 48 and the tines 38 and 70.

Figure 6:
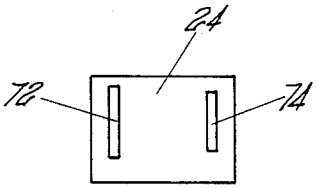
FIG. 6 is a section view taken along section lines 6—6 of FIG. 4.

FIG. 6 illustrates that the openings 24 may be rectangular in shape, such as openings 72 and 74, and in a spaced relationship to each other. In certain applications, one of the rectangular openings, such as opening 72, has a greater geometrical dimension than the other rectangular opening 74.

Figure 7:
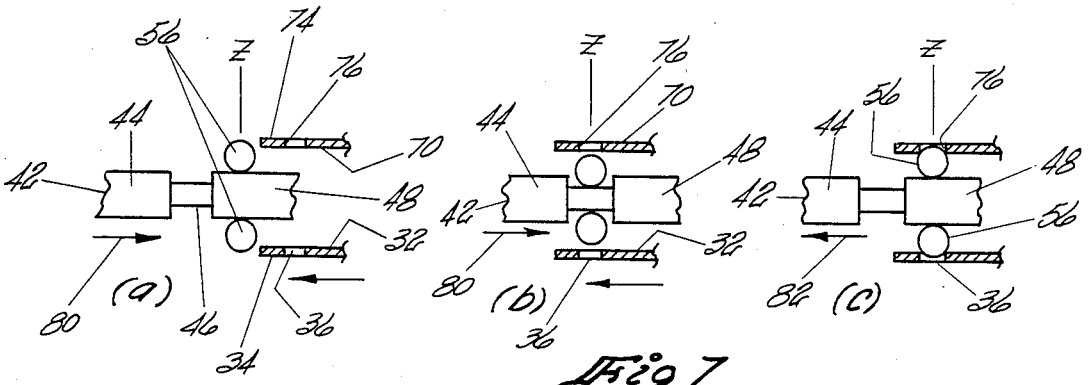
FIGS. 7(*a*); 7(*b*) and 7(*c*) are pictorial representations of the locking force being applied to the tines of an electrical plug inserted into the opening of the housing and the application of a restoring force to remove the plug therefrom.

FIGS. 7(*a*), 7(*b*) and 7(*c*) illustrate the operation of the releasable locking means relative to the tines of a plug. FIG. 7(*a*) illustrates that the elongated member 42 is moved along a linear path within the housing 22 and in a second direction, shown by arrow 80, between the tines 32 and 70 of the plug to position slot 46 adjacent the spherical members 56. As illustrated in FIG. 3, the slideable member 30 is urged towards the openings 24 causing the same to engage and move the elongated member 42. This enables the user to insert the plug all the way into the openings such that the apertures 36 and 76 engage the spherical members 56 as illustrated in FIG. 7(*b*). Thereupon, the user releases the slide member which engages the elongated member 42. FIG. 7(*a*) illustrates that the elongated member 42 is slideably mounted within the housing 22 for linear movement relative to the predetermined paths. The elongated member 42 is moved from a first position wherein the slot is remote from the predetermined locations to a second position illustrated in FIG. 7(*b*). In the second position illustrated in FIG. 7(*b*), the slot 46 is located along the predetermined paths and between the predetermined locations and the slot 46 is positioned substantially in alignment with the apertures 36 and 46 of the selected tines located at the predetermined locations in the housing 22.

FIG. 7(*c*) illustrates the elongated member 42 being moved back into the first position wherein the slot 46 is remote from the predetermined locations of the selected ends of the tines.

In operation, the resilient means, for example the spring 52 of FIG. 2, is operatively coupled to the elongated member 42 to apply a bias force in a first direction which urges and holds the elongated member 42 in the first position and which is responsive to a restoring force greater than the bias force being applied to the elongated member 42 in a second direction to move the same from the first position to the second position. The resilient means, for example spring 52, is responsive to the restoring force being released to urge the elongated member 42 in the first a direction to return the same to the first position which enables said releasable locking means to lock the tines to prevent removable thereof from the openings 24.

Figure 8:
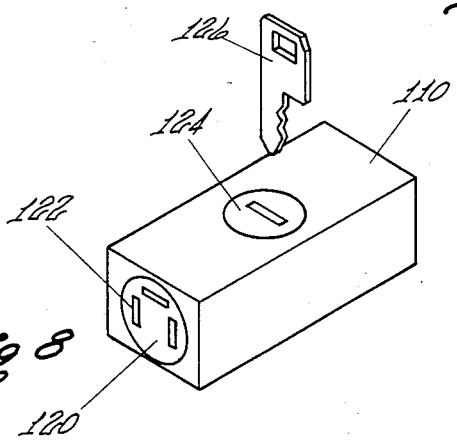
FIG. 8 is a perspective view of a yet another embodiment of a locking device having a key lock.

FIG. 8 illustrates an alternate embodiment of a locking device 110 wherein the accessing means is a key lock 124 having a slideable member which is enabled to be moved into a position to apply a restoring force the elongated member when a programmed key 126 is inserted into the key lock 124. The embodiment of FIG. 8 has a different end opening shown generally as 120 which includes rectangular opening of which opening 122 is typical.

Figure 9:
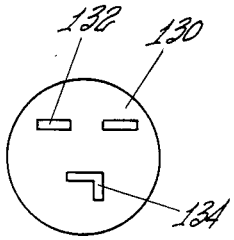
FIG. 9 is an end view of an opening in the housing which is adapted to receive a three conductor plug.

FIG. 9 illustrates an opening 130 having a geometry which is adapted to receive a 220 volt plug having a rectangular opening 132 and an "L" shaped opening to receive the grounding member.

Figure 10:
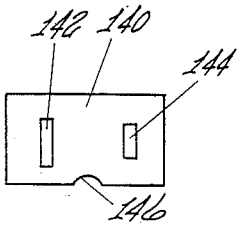
FIG. 10 is an end view of an opening in the housing which is adapted to receive a two conductor plug having one tine which has a greater geometrical dimension than the other tine.

FIG. 10 illustrates an alternate embodiment for a locking device adapted to engage the two electrical conductors of a three conductor plug having a grounding lug which is a pin and wherein the grounding lug pin is adapted to slide over indentation 146 permitting the other two conductors to be locked within the housing of a locking device.

Figure 11:
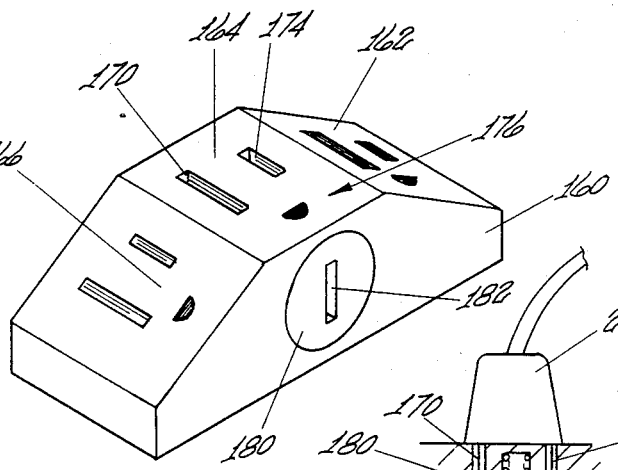
FIG. 11 is a top perspective view of another embodiment of the present invention wherein the housing has a plurality of openings to receive more than one electrical plug.

FIG. 11 illustrates another embodiment of a multiplug locking device for use with a plurality of electrical plugs each of which have a pair of spaced, parallel tines wherein each of the tines has an aperture located at a selected end thereof and wherein the apertures are positioned in spaced axial alignment with each other. The locking device is shown generally as 172 and has three positions 162, 164 and 166. Position 164 is typical and has openings 170 and 172 to receive tines of different rectangular cross-sections. The selective accessing means is a key lock 180 having a key slot 182 to receive a key.

Figure 12:
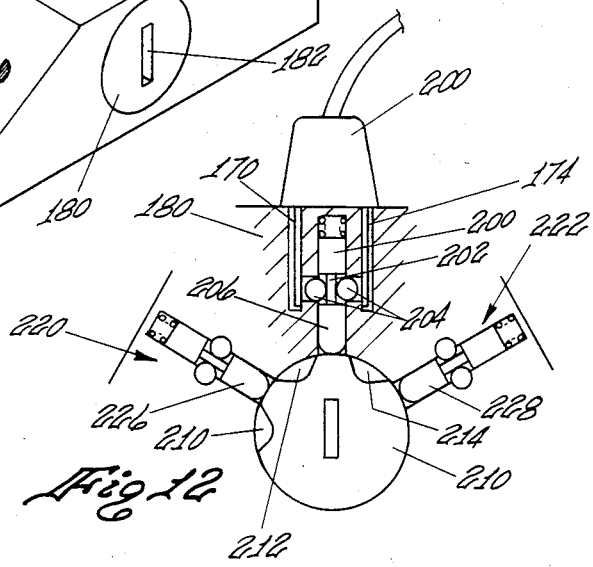
FIG. 12 is a pictorical representation of a plurality of releasable locking means for selectively locking and unlocking one or more electrical plugs which is adapted for use in the embodiment of FIG. 11.

FIG. 12 illustrates in a pictorial diagram one of the structures adapted for use in the embodiment of FIG. 11. The position 164 is illustrated in FIG. 12. The housing is identified as 180 and is adapted to cooperate with a plug 200 having tines which pass through openings 170 and 172. The releasable locking member has an elongated member 200 having a slot 202 which is adapted to cooperate with spherical members 204. The elongated member 202 has its other end formed into an arcuate shape. In a similiar manner, the elongated members located in housing sections 220 and 222 have the other ends thereof 226 and 228, respectively, formed into an arcuate shape. The accessing means is positioned within the housing adjacent the openings and including a cam surface 210 having a control edge which includes a plurality of recesses formed at selected locations thereon. The control edge are adapted to slideably engage the arcuated shaped ends 206,226 and 228 of each of the elongated members for selectively enabling access to the locking device. The accessing means cam surface 210 cooperates with the elongated members to permit each of the arcuate shaped ends 206, 226 and 228 thereof to be selectively positioned in at least one of the control edge and a recess as a function of the position of the control edge relative to the arcuate shaped ends. The accessing means cooperates with the arcuated shaped ends such that when the control edge is positioned to receive the arcuate shaped ends, each of the resilient means urges its associated elongated member in the first direction to move the elongated member in the first position and when the control edge is positioned to hold the arcuate shaped end away from the recess, a restoring force is applied to its associated elongated shaped member in the second direction to override the bias force to move the elongated member from the first position to the second position to enable the tines of the electrical plug, for example plug 200, to be removed from the openings.

The locking device of the present invention can be incorporated into a housing having the capability of receiving and locking a plurality of plugs. For example, the housing may be circular in shape and accept four plugs. Also, the locking device of FIG. 1 can utilize a selective acessing means such as a key lock. Other similiar variations are possible using the releasable locking mechanism covered by the teachings of this invention.

What is claimed is:

1. A locking device for use with an electrical plug having at least one tine having an aperture located at a selected end thereof, said locking device comprising a housing having at least one opening therein which is adapted to position the selected end of a said tine at predetermined location along a predetermined path;

at least one releasable locking means located within said housing adjacent to the opening, said at least one releasable locking means including an elongated member having a first end section and a second end section and a circumferentially extending continuous slot formed around the periphery thereof between said first end section and said second end section, said slot having a goemetrical dimension which is smaller than the geometrical dimension of the outer surface of said elongated member, said elongated member being slideably mounted within said housing for linear movement relative to said predetermined path between a first position wherein said slot is remote from the predetermined location and a second position wherein said slot is located along the predetermined path and positioned substantially in alignment with the aperture of a said selected tine located at said predetermined location; and at least one spherical member having a diameter which is substantially equal to the distance between the outer surface of said elongated member and the location where a tine is adapted to be positioned within said opening, said at least one spherical member being adapted to be positioned in said housing and between said outer surface of said elongated member and the location of an aperture of said tine adapted to be positioned within said opening for applying a locking force between said outer surface of said elongated member and a said tine adapted to be positioned in said opening and being adapted to urge the spherical member into the aperture of and locking a said tine adapted to be positioned in the opening when said elongated member is in said first position, said at least one spherical member being adapted to be moved away from the aperture in a said tine adapted to be positioned in said opening when the same is located in said predetermined location and into said slot when said elongated member is in said second position enabling the tine adapted to be positioned in said opening to be free of the locking force of said spherical member in said aperture of said tine adapted to be positioned in said opening enabling the same to be removed from said housing opening.

2. The locking device of claim 1 further comprising a resilient means operatively coupled to said elongated member to apply a bias force in a first direction which urges and holds said elongated member in said first position and which is responsive to a restoring force greater than the bias force being applied to said elongated member in a second direction to move the same from the first position to said second position and which is responsive to the restoring force being released to urge said elongated member in said first direction to return the same to the first position which enables said releasable locking means to lock said tine to prevent removable thereof from said opening.

3. The locking device of claim 2 further comprising accessing means for selectively enabling access to said locking device being positioned in said housing and located adjacent said opening, said accessing means including a force member which is adapted to engage one of said first and second ends of said elongated member to selectively apply a restoring force thereto in said second direction to move said elongated member from said first position to said second position to enable said tine to be removed from the opening.

4. The locking device of claim 3 wherein said selective accessing means is a combination lock having a slideable member wherein the slideable member is enabled to be moved into a position to apply a restoring force to said elongated member when the programmed combination is applied to said combination lock enabling said tine to be removed from said opening.

5. The locking device of claim 3 wherein said selective accessing means is a key lock having a slideable member which is enabled to be moved into a position to apply a restoring force to said elongated member when a programmed key is inserted into said key lock wherein said slide member is enabled to move said slideable member into a position to apply a restoring force to said elongated member enabling said tine to be removed from said opening.

6. The locking device of claim 2 wherein said housing includes means defining a central cavity located intermediate the spaced predetermined path, wherein the end of said elongated member closest to said housing opening has a hollowed-out area formed therein having an opening which is adapted to communicate with said central cavity and wherein said resilient means extends between said central cavity and said hollowed-out central area to apply a force on said elongated member in a direction to urge the same into said position.

7. A locking device for use with an electrical plug having a pair of spaced, parallel tines wherein each of said tines has an aperture located at a selected end thereof and wherein said apertures are positioned in spaced axial alignment with each other, said locking device comprising a housing having at least two openings therein which are adapted to position the selected ends of said tines at predetermined locations along spaced predetermined paths;

a releasable locking means located within said housing adjacent the opening, said releasable locking means including an elongated member having first and second ends and a circumferentially extending continuous slot formed around the periphery thereof at a selected location between said first and second ends, said slot having a geometrical dimension which is smaller than the geometrical dimension of the outer surface of said elongated member, said elongated member being slidably mounted within said housing for linear movement relative to said predetermined paths between a first position wherein said slot is remote from the predetermined locations and a second position wherein said slot is located along the predetermined paths and between the predetermined locations and wherein the slot is positioned to be substantially in alignment with the apertures of said selected tines located at said predetermined locations;

a pair of spherical members each having a diameter which is substantially equal to the distance between the outer surface of said elongated member and the location where one of the tines of a plug is adapted to be positioned within said openings, said spherical members being positioned in said housing and between said outer surface of said elongated member and the locations of apertures in the selected ends of said tines adapted to be positioned within said opening for applying a locking force between said outer surface of said elongated member and said selected ends of said tines adapted to be positioned within said opening and being adapted to urge the spherical members into the apertures of and locking the tines adapted to be positioned in the opening when said elongated member is in said first position, said spherical members being adapted to be moved away from the apertues in said selected ends of tines adapted to be positioned within said opening when the same are located in said predetermined locations and into said slot when said elongated member is in said second position enabling the tines adapted to be positioned within said opening enabling the same to be removed from said housing opening.

8. The locking device of claim 7 further comprising a resilient means operatively coupled to said elongated member to apply a bias force in a first direction which urges and holds said elongated member in said first position and which is responsive to a restoring force greater than the bias force being applied to said elongated member in a second direction to move the same from the first position to said second position and which is responsive to the restoring force being released to urge said elongated member in said first a direction to return the same to the first position which enables said releasable locking means to lock said tines to prevent removal thereof from said opening.

9. The locking device of claim 7 further comprising accessing means for selectively enabling access to said locking device being positioned in said housing and located adjacent to said opening, said accessing means including a force member which is adapted to engage said other ends of said elongated member to selectively apply a restoring force thereto in said second direction to move said elongated member from said first position to said second position to enable said tine to be removed from the opening.

10. The locking device of claim 9 wherein said selective accessing means is a combination lock having a slideable member wherein the slideable member is enabled to be moved into a position to apply a restoring force to said elongated member when the programmed combination is applied to said combination lock enabling said tine to be removed from said opening.

11. The locking device of claim 9 wherein said selective accessing means is a key lock having a slideable member which is enabled to be moved into a position to apply a restoring force to said elongated member when a programmed key is inserted into said key lock wherein said slide member is enabled to move said slideable member into a position to apply a restoring force to said elongated member enabling said tine to be removed from said opening.

12. The locking device of claim 2 wherein said resilient means is a spiral spring.

13. The locking device of claim 1 wherein said openings are rectangular in shape and in a spaced relationship to each other.

14. The locking device of claim 13 wherein one of the rectangular openings has a greater geometrical dimension than the other rectangular opening.

15. The locking device of claim 14 wherein said housing has a third opening adapted to receive a grounding plug member.

16. A locking device for use with a plurality of electrical plugs each of which have a pair of spaced, parallel tines wherein each of said tines has an aperture located at a selected end thereof and wherein said apertures are positioned in spaced axial alignment with each other, said locking device comprising a housing having a plurality of openings each of which is adapted to receive the tines of one electrical plug and wherein the openings are adapted to position the selected ends of said tines at predetermined locations along its respective spaced predetermined paths;

a plurality of releasable locking means one of which is located within said housing adjacent each the opening, each of said releasable locking means including an elongated member having first and second ends and a circumferentially extending continuous slot formed around the periphery thereof at a selected location between said first and second ends, said slot having a geometrical dimension which is smaller than the geometrical dimension of the outer surface of said elongated member, said elongated member being slideably mounted within said housing for linear movement relative to said predetermined paths between a first position wherein said slot is remote from the predetermined locations and a second position wherein said slot is located along the predetermined path and between the predetermined locations and wherein the slot is positioned to be substantially in alignment with apertures of said selected tines located at said predetermined locations; and a pair of spherical members each having a diameter which is substantially equal to the distance between the outer surface of said elongated member and the location where one of the tines of an electrical plug is adapted to be positioned within said openings, said spherical members being positioned in said housing between said outer surface of said elongated member and the locations of apertures in the selected ends of said tines adapted to be positioned within said opening for applying a locking force between said outer surface of said elongated member and said selected ends of said tines adapted to be positioned within said opening and being adapted to urge the spherical members into the apertures of and locking the tines adapted to be positioned in the opening when said elongated member is in said first position, said spherical members being adapted to be moved away from the apertures in said selected ends of tines adapted to be positioned within said opening when the same are located in said predetermined locations and into said slot when said elongated member is in said second position enabling the tines adapted to be positioned within said opening to be free of the locking force of said spherical members in said apertures of said tines adapted to be positioned within said opening enabling the same to be removed from said housing opening.

17. The locking device of claim 16 wherein each of said releasable locking means further comprises a resilient means operatively coupled to said elongated member to apply a bias force in a first direction which urges and holds said elongated member into said first position and which is responsive to a restoring force greater than the bias force being applied to said elongated member in a second direction to move the same from the first position to said second position and which is responsive to the restoring force being released to urge said elongated member in a first direction to return the same to the first position which enables said releasable locking means to lock said tines to prevent removable therof from said opening.

18. The locking device of claim 17 further comprising accessing means for selectively enabling access to said locking device being positioned in said housing and located adjacent said opening, said accessing means including a force member which is adapted to engage one of said first and second ends of each of said elongated members to selectively apply a restoring force thereto in a direction to move each of said elongated members from said first position to said second position to enable said tines to be removed from the opening.

19. The locking device of claim 17 wherein the other end of each of said elongated members is formed into an arcuate shape and further comprising accessing means being positioned within said housing adjacent said openings and including a cam surface having a control edge including a plurality of recesses formed at selected locations thereon, said control edge being adapted to slideably engage the arcuated shaped ends of each of said elongated members for selectively enabling access to said locking device, said accessing means cam surface cooperating with said elongated members to permit each of said arcuate shaped ends thereof to be selectively positioned in at least one of said control edge and a recess as a function of the position of said control edge relative to said arcuate shaped ends, said accessing means cooperating with said arcuated shaped ends such that when said control edge is positioned to receive said arcuate shaped ends each of said resilient means urges its associated elongated member in said first direction to move said elongated member in said first position and when said control edge is positioned to hold said arcuate shaped end away from said recess a restoring force is applied to its associated said elongated shaped member in said second direction to override said bias force to move said elongated member from said first position to said second position to enable said tines to be removed from the openings.

20. The locking device of claim 19 wherein said selective accessing device is a key lock having said cam surface formed thereon which when in a locked position permits each of said arcuate shaped end members of each elongated end to reside in a selected recess and wherein the cam surface is moved to an unlocked position when a programmed key is inserted into said key lock wherein said cam surface engages and moves each of said ends of said elongated member in said second direction to move said slideable member into position to apply a restoring force to each of said elongated members enabling said tines to be removed from its associated opening.

* * * * *